US007201024B2

(12) United States Patent
Hirayama et al.

(10) Patent No.: US 7,201,024 B2
(45) Date of Patent: Apr. 10, 2007

(54) ELASTIC WARP-KNIT FABRIC

(75) Inventors: Hiroaki Hirayama, Osaka (JP); Akihiko Hori, Shiga (JP)

(73) Assignee: Kawashimaorimono Co., Ltd., Kyoto (JP)

( * ) Notice: Subject to any disclaimer, the term of this patent is extended or adjusted under 35 U.S.C. 154(b) by 79 days.

(21) Appl. No.: 10/526,117

(22) PCT Filed: Aug. 28, 2003

(86) PCT No.: PCT/JP03/10911

§ 371 (c)(1),
(2), (4) Date: Feb. 28, 2005

(87) PCT Pub. No.: WO2004/022827

PCT Pub. Date: Mar. 18, 2004

(65) Prior Publication Data

US 2006/0059954 A1 Mar. 23, 2006

(30) Foreign Application Priority Data

Sep. 9, 2002 (JP) ..... 2002-262781

(51) Int. Cl.
*D04B 23/12* (2006.01)

(52) U.S. Cl. ..... 66/192; 66/195

(58) Field of Classification Search ..... 66/195, 66/193, 202; 442/306, 312–314
See application file for complete search history.

(56) References Cited

U.S. PATENT DOCUMENTS

| | | | | | |
|---|---|---|---|---|---|
| 4,425,398 | A * | 1/1984 | Berczi | 66/193 |
| 4,518,640 | A * | 5/1985 | Wilkens | 66/192 |
| 4,615,934 | A * | 10/1986 | Ellison | 66/190 |
| 4,845,963 | A * | 7/1989 | Parekh | 66/170 |
| 5,317,886 | A * | 6/1994 | Prahl | 66/192 |
| 5,415,007 | A * | 5/1995 | Eng | 66/192 |
| 6,389,851 | B1 | 5/2002 | Groshens | |
| 7,013,681 | B1 * | 3/2006 | Ternon et al. | 66/192 |
| 2001/0013233 | A1 | 8/2001 | Motoya | |

FOREIGN PATENT DOCUMENTS

| | | |
|---|---|---|
| EP | 0 936 295 A1 | 8/1999 |
| EP | 1 106 722 A1 | 6/2001 |
| JP | 08-158217 | 6/1996 |
| JP | 11-081108 | 3/1999 |
| JP | 11-279907 | 10/1999 |
| JP | 2000-248450 | 9/2000 |
| JP | 2001-164447 | 6/2001 |

* cited by examiner

*Primary Examiner*—Danny Worrell
(74) *Attorney, Agent, or Firm*—Synnestvedt & Lechner LLP

(57) ABSTRACT

A fabric article useful for the cushioning surface of a car seat and like items is formed from thick main elastic yarn which is thicker than main stitch yarn, and main inserted yarn which is more bulky and thicker than the main elastic yarn in apparent thickness, are knitted in line in the knitting width direction or in the knitting length direction of a mesh-like base knitted fabric which is knitted up with main stitch yarns by using a warp knitting machine and which have openings which are larger than the needle loops formed from the stitch yarn and extend over plural knitting courses.

7 Claims, 3 Drawing Sheets

ELASTIC WARP-KNIT FABRIC

FIELD OF THE INVENTION

The present invention relates to an air-permeable warp knitted elastic mesh fabric which is used to form a cushioning surface of a body support such as a legless-chair, single-chair, bench, seat-backrest, seat-footrest, car-seat, sofa, bed and the like, which is used to elastically support a body indoors, outdoors or inside of a car, by stretching (hanging) the fabric between frame parts of a frame.

BACKGROUND OF THE INVENTION

As disclosed in Japanese Patent Laid Open No. 11-279906, Japanese Utility Model Laid Open No. 56-103080 and Japanese Utility Model Laid Open No. 54-139779, warp knitted elastic mesh fabrics having openings, each of which is larger than a needle loop formed from the stitch yarn extending over plural knitting courses, are well known.

As disclosed in Japanese Patent Laid Open No. 11-279907 and Japanese Utility Model Publication No. 3-36555, weft inserted warp knitted fabrics having inserted yarns, which are knitted into a base knitted fabric formed from main stitch yarns by a warp knitting machine and which are in continuous in line in the knitting width direction, and warp inserted warp knitted fabrics having inserted yarns, which are knitted into base knitted fabric formed from main stitch yarns by a warp knitting machine and are in continuous line in the knitting length direction, are well known.

As disclosed in Japanese Patent Laid Open No. 11-279907, Japanese Patent No. 3096356 and Japanese Patent Gazette 62-60489, the knitting method of threading an elastic yarn into warp knitted fabrics is well known.

As disclosed in Japanese Patent No. 3096356, 11-279907, polyether-ester elastic yarn is well known as the elastic yarn to be threaded into warp knitted fabrics.

It is known to apply a woven elastic fabric, on which surface a honey-comb pattern was drawn with a leno and gauze textile design, to the cushioning surface of the car-seat and the like. The leno and gauze textile design may be woven in a manner where monofilament elastic yarns of a fineness of about 2000 dtex are applied to warp yarns and, multifilament bulky texturized yarns having an apparent thickness which is thicker than the monofilament elastic yarns are applied to weft yarns, warp yarns arranged in the weaving width direction are classified into 8 groups, open sheds are formed by each pair of adjacent warp yarns of each group, the shedding motion (open shed) is changed every picking, and two weft yarns which are picked into the open shed in order are tied up by the pair of adjacent warp yarns (FIG. 5).

In the case of application of the warp knitted mesh fabric to the cushioning surface of the car-seat, the cushioning surface which has good air-permeability, and gives a cool feeling to touch, and does not give a warm sticky feeling, may be obtained. However, conventional warp knitted mesh fabric applied to the cushioning surface can not bear up in use, since loosened puckers arise and a recess (sagging) appears over the cushioning surface in use.

In this connection, in the case of the application of the weft inserted warp knitted fabrics, where the elastic yarn is threaded in, and the warp inserted warp knitted fabrics, where the elastic yarn is threaded in, to the cushioning surface, loosened puckers and recesses or sagging may be avoided by the elastic yarn and a durable car-seat or the like may be obtained.

For this purpose, it is necessary to densely thread the monofilament elastic yarns of single fiber fineness of more than 1500 dtex into the base knitted fabric so that stress at 10% elongation in the direction where the elastic yarn may be continuous in the warp knitted fabric is more than 100 N/5 cm.

However, in the case of application of such a thick monofilament elastic yarn, the surface of the warp knitted fabric becomes similar to the monotonous simple surface of the conventional plastic sheet goods. So that a car-seat or a like article having high market value can not be obtained. Since the surface of the monofilament elastic yarn, which is thick in single fiber fineness, is flat and slippery like the surface of fishline, so that a soft and quite natural fine appearance, which is covered with fine fibers, can not be formed over the surface of the warp knitted fabric.

The surface of woven elastic fabric, where thick monofilament elastic yarns are densely woven in and exposed over the surface of woven elastic fabric like a mat rush of facing tatami mats, is flat, slippery, and glossy, so that, when limbs are put on the cushioning surface formed from such an elastic fabric, limbs will slip, and can not be maintained in a comfortable posture producing a feeling of fatigue.

The woven elastic fabric woven on which surface a honey-comb pattern is drawn out is lacking in size and shape stability, so that a cushioning surface of high durability can not be formed. Since the honey-comb pattern is formed with weft yarns which are in a tortuous path in a zigzag manner in the weaving width direction, when tension acts in the weaving width direction, these weft yarns are elongated and transformed in line.

Therefore, the present invention intends to provide an improved warp knitted elastic fabric which is useful for the cushioning surface of a car-seat and the like, and has the following properties: it does not cause a recess and loosened pucker resulting from load-hysteresis fatigue in use for the cushioning surface; it has high dimensional stability; it does not cause a distortion of stitch openings; it has high air-permeability; it does not give a warm sticky feeling; it is able to maintain limbs of the user in comfortable posture without slippage when limbs are put on the cushioning surface; it has a soft feeling when touched; it is not glossy; it has a soft and a quite natural fine appearance covered with fine fibers; it is not similar to the monotonous simple surface of the conventional plastic goods in appearance; and it has a high market value.

SUMMARY OF THE INVENTION

A warp knitted elastic fabric, in accordance with the present invention, has a first characteristic comprised of the following elements (1), (2), (3) and (4).

(Element 1)

A base knitted fabric (10) is knitted up from main stitch yarns by using a warp knitting machine.

(Element 2)

Main elastic yarns (14) are knitted in the base knitted fabric (10) and are in continuous in line in the knitting width direction (C) or in the knitting length direction (W).

(Element 3)

Main inserted yarns (15) are knitted in the base knitted fabric (10) and are in continuous in line in the knitting width direction (C) or in the knitting length direction (W).

(Element 4)

Main inserted yarns (15) are more bulky than both main elastic yarns (14) and main stitch yarns, and main inserted yarns (15) are thicker in apparent thickness than both main elastic yarns (14) and main stitch yarns.

The warp knitted elastic fabric does not produce a monotonous simple imagine similar to plastic goods since a flatness and glossy appearance of the surface is restrained by the light absorption of the main inserted yarns (15) of which surface is made from countless fibers and has low light reflection.

And, the knitted elastic fabric has a very soft feeling when touched and is useful for the cushioning surface of a car-seat and a like, since the main inserted yarns (15) are thick in apparent thickness and very bulky and the countless fluff and pile fibers of the surface of the main inserted yarns are to be projected between adjacent sinker loops (18,18) of the main stitch yarn and are not depressed and covered with the sinker loops (18,18) of the main stitch yarn.

In addition to the first characteristic set forth above, the warp knitted elastic fabric, in accordance with the present invention, has the second characteristic comprised of the following elements (1) and (2).

(Element 1)

On the base knitted fabric (10), there are openings (16) which are larger than the needle loop (17) formed from the main stitch yarn and which extend over plural knitting courses.

(Element 2)

The base knitted fabric (10) is formed as a mesh.

The surface of the main inserted yarn (15) is covered with countless fibers and lacks light reflection.

Thus, the surface gloss and flatness of the fabric is restrained by the light absorption of the main inserted yarns (15).

In addition, the fine shape of an opening (16) acts to disrupt an occurrence of surface gloss.

Thus, the warp knitted elastic fabric has a quite natural appearance and high air-permeability and cool touch feeling, and does not have a monotonous simple imagine similarly to sheet plastic goods, and becomes easy to mould by fitting to the configuration of the frame (23) of the car-seat and the like.

In addition to the characteristics of the first and the second, the warp knitted elastic fabric, in accordance with the present invention, has the tenth characteristic comprised of the following element (1).

(Element 1)

The main inserted yarn (15) is chenille yarn which is formed with axis yarns and pile fibers for covering the axis yarns wherein the pile fibers are projecting from the axis yarns.

Since the pile fibers of the main inserted yarn (chenille yarn 15) are projecting and covering the surface of the warp knitted elastic fabric and effect non-slip action, limbs resting on the cushioning surface (24) are not in slippage but supported in comfortable posture, and the pile fibers have a comfortable feeling when touched. Because of these properties, the warp knitted elastic fabric becomes suitable for the cushioning surface.

In addition to any one of the above characteristics of the first the second and the third, the warp knitted elastic fabric, in accordance with the present invention, has a sixth characteristic comprised of the following element (1).

(Element 1)

The main stitch yarn is a thermo-adhesive sheath/core combination of polyether-ester yarn which is made of polyether-ester applied to a core component polymer and thermo-adhesive polymer having a melting point which is lower than core component polymer, applied to the sheath component polymer.

When this warp knitted elastic fabric is finished up by passing through a dry-heating treatment, the main elastic yarn and the main stitch yarn are thermally adhered. Then, the warp knitted elastic fabric which does not cause distortion of stitch openings under reiterative stretching, and which is rich in abrasion resistance and dimensional stability, and which is useful for the cushioning surface, can be obtained.

In addition to any one of the above characteristics of the first, the second, the third and the fourth, the warp knitted elastic fabric, in accordance with the present invention, has the twelfth characteristic comprised of the following element (1).

(Element 1)

The main elastic yarn (14) is a thermo-adhesive sheath/core combination polyether-ester elastic yarn which is made of elastic polyether-ester applied to a core component polymer and thermo-adhesive polymer having a melting point lower than the core component polymer applied to the sheath component polymer.

As mentioned above, when this warp knitted elastic fabric is finished up by passing through dry-heating treatment, the main elastic yarn and the main stitch yarn are thermally adhered. Then, the warp knitted elastic fabric, which does not cause distortion of stitch openings under reiterative stretching, and which is rich in abrasion resistance and dimensional stability, and which is useful for the cushioning surface, can be obtained.

In addition to any one of the above characteristics of the first through the fifth, the warp knitted elastic fabric, in accordance with the present invention, has the thirteenth characteristic comprised of the following element (1).

(Element 1)

The fineness of the plurality of the main elastic yarns (14) which is included within the unit distance (1 cm) in the knitting length direction (W) or in the knitting width direction (C) should be more than 7000 dtex/cm.

This warp knitted elastic fabric is improved when it is applied to the cushioning surface (24) by stretching and hanging over the frame (23). Sagging and loosened pucker do not arise under repeated loading due to limbs or body weight, and it is highly durable and becomes suitable for the cushioning surface (24).

In addition to any one of the above first through sixth characteristics, the warp knitted elastic fabric, in accordance with the present invention, has the ninth characteristic comprised of the following element (1).

(Element 1)

The main elastic yarn (14) and the main inserted yarn (15) are knitted in respectively the different course of the base knitted fabric (10).

In this case, the main elastic yarn (14) and the main inserted yarn (15) are set apart from one another by the needle loop (17) and the sinker loop (18) of the main stitch yarn and are aligned in parallel with one another.

Because of this, in the application for the cushioning surface (24) of the frame (23) of the car-seat and the like, the main inserted yarn (15) does not touch with the stretchable main elastic yarn (14). Therefore, the main elastic yarn (14) can not be rubbed by the main inserted yarn (15), so that it does not wear out easily. And, stretching actions of the main elastic yarn (14) are not interfered with by the main inserted yarn (15). Thus, the warp knitted elastic fabric has enhanced properties of stretchability and abrasion resistance and becomes suitable for the cushioning surface.

DETAILED DESCRIPTION OF THE INVENTION

Figure 1:
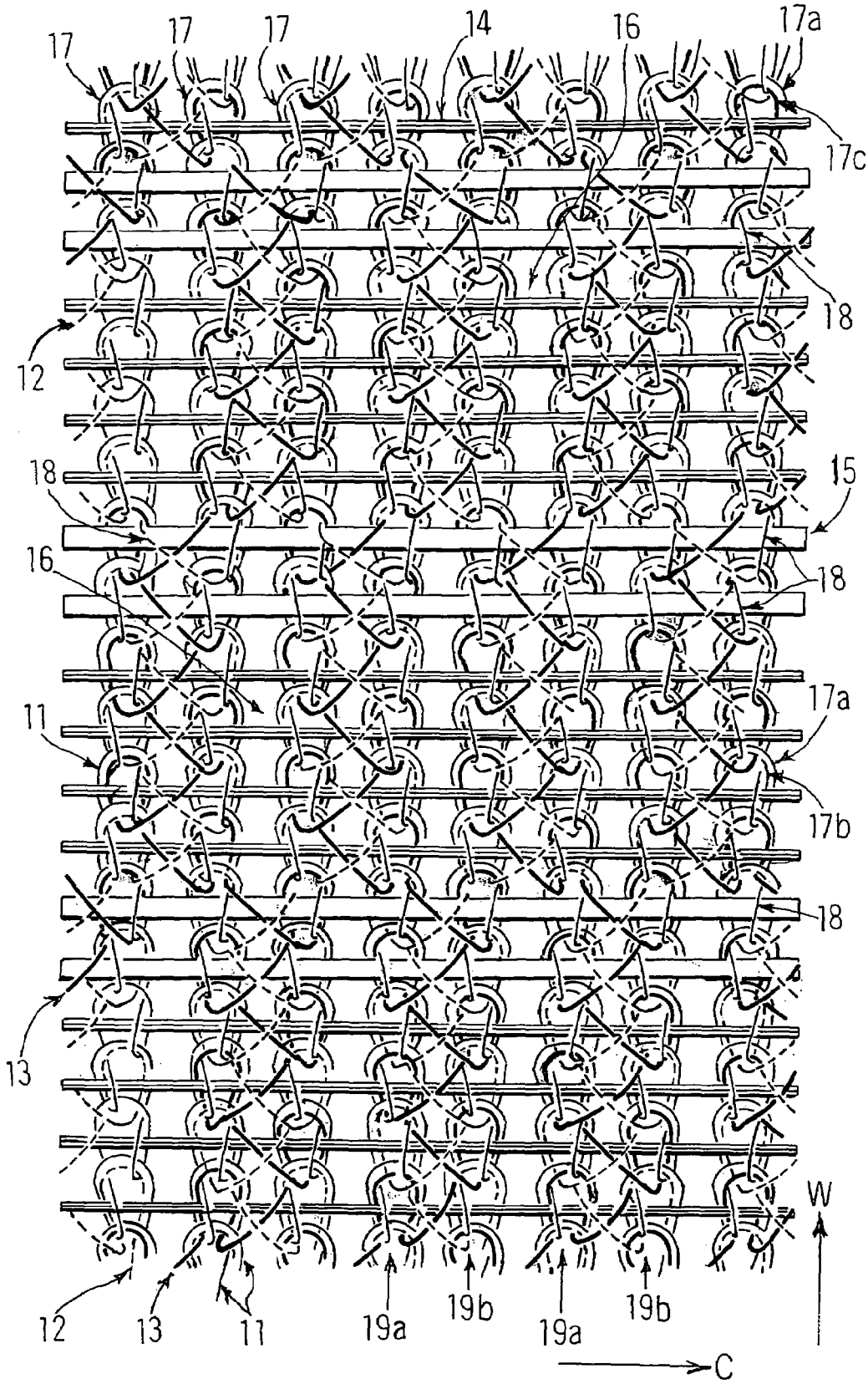
FIG. 1 is a plan view of a warp knitted elastic fabric on a knitting process in accordance with the present invention.

As mentioned above, weft inserted warp knitted fabrics having inserted yarns knitted into the base knitted fabric (10) in line in the knitting width direction (C) and warp inserted warp knitted fabrics having inserted yarns knitted into the base knitted fabric (10) in line in the knitting length direction (W) are well known as disclosed in Japanese Patent Laid Open No. 11-279907 and Japanese Utility Model Publication No. 3-36555.

Conventional raschel warp knitting machines having a weft yarn insert apparatus or a warp yarn insert apparatus can be applied to knit up the warp knitted elastic fabric in accordance with the present invention.

A reason to knit the main elastic yarn (14) into the base knitted fabric is to increase the cushioning property and dimensional stability of the base knitted fabric and is to restrain occurrence of recessing or sagging and loosened pucker on the cushioning surface of the car-seat and the like during use.

For this purpose, it is desirable to apply a thick monofilament elastic yarn of breaking elongation more than 60% having a rate of elastic recovery after 30% elongation of more than 90% single fiber fineness of 1000~4000 dtex, preferrably 1650~2750 dtex, further preferably 2000~2500 dtex, and of which stress 10% elongation is more than 0.1 cN/dtex, preferably 0.2~8 cN/dtex, to the main elastic yarn (14).

The main elastic yarn (14) is knitted into the base knitted fabric (10) so that stress (F) at 10% elongation of the warp knitted elastic fabric in the knitting length or width direction where the main elastic yarn (14) is in continuous in line is between 150~600 (cN/dtex)($150 \leqq F \leqq 600$).

For that the stress (F: N/5 cm) at 10% elongation of the warp knitted elastic fabric is between 150~600 (N/5 cm), it is desirable to maintain the sum (total) fineness of a plurality of the main elastic yarns (14), which is included within the unit distance (1 cm) in the knitting length direction or in the knitting width direction at more than 7000 dtex/cm.

Polyester elastic yarn, polyurethane elastic yarn and polyether-ester elastic yarn are well known as high elastic yarns which have a high rate of elastic recovery in connection with elongated strain (elongation).

Among them, polyether-ester elastic yarn is most suitable for the present invention because stress at 10% elongation of polyester elastic yarn is about 2.2 (cN/dtex) and strongest of all.

Stress at 10% elongation of polyether-ester elastic yarn is about 0.27 (cN/dtex).

Stress at 10% elongation of polyurethane elastic yarn is about 0.015 (cN/dtex) the weakest of all.

Figure 2:
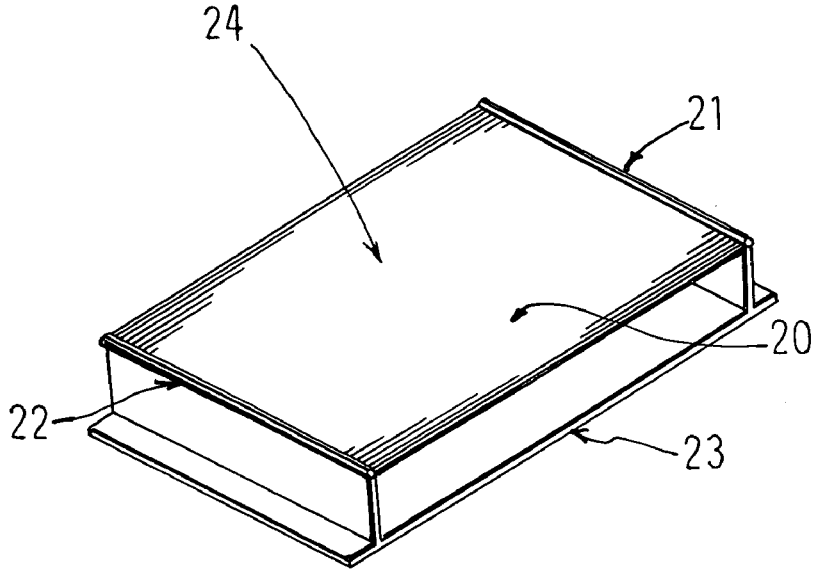
FIG. 2 is a perspective view of a seat wherein a fabric is hanged over.

By the way, as shown in FIG. 2, the present invention relates to the warp knitted elastic fabric (20) to be applied to the cushioning surface (24) by stretching and hanging over the frame (23).

For the warp knitted elastic fabric (20) used as materials of cushioning surface (24), when polyurethane elastic yarn is applied in place of polyether-ester elastic yarn, since polyurethane elastic yarn is substantially weaker than polyether-ester elastic yarn, a part of the cushioning surface (24) deeply sags and moves to and fro due to the weight of limbs and the limbs are not stably supported.

On the other hand, when polyester elastic yarn is applied in place of polyether-ester elastic yarn, since polyester elastic yarn is extraordinarily stronger than polyether-ester elastic yarn, though a part of the cushioning surface (24) does not deeply sag, the cushioning surface (24) which is formed is hard, and it effects an uncomfortable touch feeling that it can not help to keep limbs on the cushioning surface in use.

And, in the case of application of weak and elongatable polyurethane elastic yarn, irregularity of tension tends to arise in the warp knitted elastic fabric at a time of stretching and hanging it over the frame (23).

On the other hand, in the case of application of strong and unelongatable polyester elastic yarn, pucker tends to arise over the warp knitted elastic fabric at a time of stretching and hanging it over the frame (23). And, bentpucker and other irregular distortions, which arise over the warp knitted elastic fabric before application to the cushioning surface, can not be easily cured by the way of stretching or expanding it.

Further, in the case of application of weak and elongatable polyurethane elastic yarn, irregularity of tension among the stitch yarns tends to arise in the knitting process, and the irregularity of tension among the stitch yarns makes the knitting process difficult. And, in the case of the application of strong and unelongatable polyester elastic yarn, it becomes difficult to knit up the warp knitted elastic fabric, since in the knitting process the strong and unelongatable polyester elastic yarn does not easily vary its shape in cooperation with works or actions of the reed guide, the knit needle and other parts of the knitting apparatus.

In consideration of these matters, it is advantageous to use polyether-ester elastic yarn of which stress at 10% elongation is extraordinarily stronger than polyurethane elastic yarn in the main elastic yarn and main stitch yarn.

The reason for knitting the main inserted yarn (15) into the base knitted fabric is that the flatness, the slipperiness, and the surface gloss of the warp knitted elastic fabric (20), which may be effected by thick flat and glossy monofilament elastic yarn (main elastic yarn 14) which is thick like a fishline and has flat and very glossy surface, is restrained by the main inserted yarn (15). Another reason for use of the main inserted yarn (15) is that the soft fine and quite natural appearance of the warp knitted elastic fabric (20) as one kind of warp knitted fabric are maintained by the main inserted yarn (15) so it should not be disturbed by the monofilament elastic yarn (main elastic yarn 14) and should not become similar to the monotonous simple surface of the conventional plastic goods.

Accordingly, multi-fiber yarn of which the surface is composed of multiple fibers in bulk and lacking in surface gloss is applied to the main inserted yarn. In this case, spun yarn, multifilament bulky texturized yarn, chenille yarn and the like may be preferably used as multi-fiber yarn. The multi-fiber yarn (main inserted yarn 15) is knitted into the base knitted fabric (10) with density of insertion, that is, rate of number (threads) of the main inserted yarns (15) versus regular interval (1 cm) where the main inserted yarns are arranged in parallel with one another toward the orthogonal direction which is at right angles to the prolonging direction where the inserted yarns prolong, of more than 1 (threads/cm), preferably more than 2 (threads/cm), or the multi-fiber yarn (main inserted yarn 15) is knitted into the base knitted fabric (10) with rate of insertion of more than 1 (1 thread) of the main inserted yarn (15) versus 7 (7 thread) of the main elastic yarn (14) (that is, more than 1:7), preferably more than 1 (1 thread) of the main inserted yarn (15) versus 4 (4 thread) of the main elastic yarns (14) (that is, more than 1:4).

Total fineness of the main inserted yarns (15) may be set up 1000~5000 dtex, preferably 2000~4000 dtex.

In the present invention, main elastic yarn of 1000~4000 (dtex) and main inserted yarn of 1000~5000 (dtex) may be used.

These yarns (14,15) do not disturb the knitting process of the warp knitted elastic fabric, since these yarns (14,15) are different from the main stitch yarn (11,12,13) which form the base knitted fabric (10). That is, these yarns (14,15) are to be inserted and knitted in between needle loops and sinker loops (17,18) in a manner where these yarns (14,15) are arranged in parallel with one another without forming a needle loop and a sinker loop.

Preferably, main inserted yarn (15) is a chenille yarn which is bulky, which is made by covering axis yarns with countless pile fibers and thick in apparent thickness.

The chenille yarn may be any one of fancy yarn which is formed by twining decorative yarns to core-yarns and by binding the decorative yarns and the core-yarns with bind yarns to form pile fibers with the decorative yarns, so called chenille yarn which is formed by putting cut pieces of pile fiber between axis yarns and by twisting the axis yarns to fix the cut pieces between the axis yarns, and flocky yarn which is formed by electrostatically fixing pile fibers to axis yarn.

In the case of the fancy yarn, it is desirable to apply a thermo-adhesive yarn (for example: the product Torey Co. Ltd. of Japan, sold under the trade name "Erder") to the binding yarn to thermally adhere and fix the decorative yarn to the core-yarns through the binding yarns.

The main stitch yarns are composed of at least two kinds of the first main stitch yarn (11) and the second main stitch yarn (12).

The base knitted fabric (10) is knitted up in a manner where the first main stitch yarns (11) are applied to form chain stitched rows (19) which are continuous in the knitting length direction (W), the second main stitch yarns (12) are applied to form needle loops (17*b*) which are combined in one united needle loop with the needle loop (17*a*) of the first main stitch yarn (11), and the second main stitch yarns (12) are also applied to connect adjacent chain stitched rows (19*a*,19*b*) of adjacent first main stitch yarns (11,11) shifting laterally between the adjacent chain stitched rows (19*a*,19*b*).

Reasons to knit up the base knitted fabric (10) in the above manner are explained as follows.

That is, in the case of warp inserted warp knitted fabrics where the main elastic yarn and the main inserted yarn are knitted in the knitting length direction (W), since the main elastic yarns (14) and the main inserted yarns (15) are to be aligned in parallel with the chain stitched row (19) of the first main stitch yarn (11), it becomes easy to knit in the main elastic yarns (14) and the main inserted yarns (15) into the base knitted fabric (10).

And, in the case of weft inserted warp knitted fabrics where the main elastic yarn and the main inserted yarn are knitted in the knitting width direction (C), strength in the knitting length direction (W) is ensured by the chain stitched rows of the first main stitch yarn corresponding to strength in the knitting length direction (W) where the fabrics are reinforced by the main elastic yarns and the main inserted yarn.

It is desirable to combine the main stitch yarns with at least three kinds of stitch yarn of the first main stitch yarns (11), the second main stitch yarns (12) and the third main stitch yarns (13).

In this case, the first main stitch yarns (11) form chain stitched rows (19) which are continuous in the knitting length direction (W), and the second main stitch yarns (12) and the third main stitch yarns (13) are applied to bind and reinforce the adjacent chain stitched rows (19*a*,19*b*) of adjacent first main stitch yarns over several courses.

Further, the second main stitch yarns (12) and the third main stitch yarns (13) are applied to bind and reinforce the adjacent chain stitched rows formed from respectively different first main stitch yarns (11) over several courses in a manner where the second main stitch yarns (12) and the third main stitch yarns (13) are respectively shifted laterally one wale in the opposite direction, that is, to shift between the adjacent chain stitched rows (19*a*,19*b*), by changing shifting direction every course.

Thereby, the opening which is enclosed by reinforced left and right chain stitched rows in the knitting width direction (C) and reinforced front and rear chain stitched rows in the knitting length direction (W) is formed.

Further, for improvement of strength and dimensional stability of the warp knitted elastic fabric, thermo-adhesive sheath/core combination polyether-ester elastic yarn which is made of polyether-ester applied to a core component polymer and thermo-adhesive polymer having a melting point lower than the core component polymer, is applied to at least either of the main elastic yarn (14) and the main stitch yarn, preferably at least either of the main elastic yarn (14) and the first main stitch yarn (11).

And, heat treatment is applied to the warp knitted elastic fabric after the knitting process to thermally adhere the main elastic yarn and main stitch yarn.

Thereby, the needle loop and sinker loop of the base knitted fabric are finished up dimensionally stable.

In this way, the main elastic yarn and the main inserted yarn are fixed to the base knitted fabric, the distortion of stitch openings is.

As the thermo-adhesive sheath/core combination polyether-ester elastic yarn, "Dia-Flora" (product name of Toyobo Co. Ltd., fineness: 2080 dtex) is well known.

Total fineness of the main stitch yarn may be set up less than one half of total fineness of the main elastic yarn, preferably less than one quarter of total fineness of the main elastic yarn, generally 100~800 dtex, preferably 300~800 dtex.

In the case of application of a sheath/core combination filament elastic yarn, which is made of lower melting point polyether-ester elastomer applied to sheath component part and higher melting point polyether-ester elastomer applied to core component part, for the first main stitch yarn (11), it is desirable to apply a polyester multifilament yarn to the second main stitch yarn (12) and the third main stitch yarn (13), because the polyester multifilament yarn is compatible with the sheath/core combination filament elastic yarn in connection with the polyester component, thus these yarns easily thermally adhere to one another.

When the polyether-ester elastic yarn is applied to the main elastic yarn, the dyeing process of the warp knitted elastic fabric may be carried out easily, either polyether-ester elastic yarn or polyester multifilament yarn is applied to the first main stitch yarn, the polyester multifilament yarn is applied to the second main stitch yarn and the third main stitch yarn, and also the polyester multifilament yarn is applied to the main inserted yarn.

That is, in connection with the dyeing property, textile materials of the warp knitted elastic fabric is to be standardized.

For the sake of improvement of weathering fastness of the warp knitted elastic fabric, as one kind of pigment colored fibers, the polyether-ester elastic yarn and the polyester multifilament yarn are spun by adding a pigment to the spinning polymer and, if necessary, treated in the dyeing process.

In the case of application of pigment colored polyether-ester elastic yarn and pigment colored polyester multifilament yarn, the dyeing process of the warp knitted elastic fabric is thus carried out more efficiently.

At the inside of the warp knitted elastic fabric, the main elastic yarn (14) is set in a hard stretching situation since it is in parallel with the inelastic main inserted yarn (15) and its stretching elasticity is restrained or limited by this inelastic main inserted yarn (15).

To avoid such restraint, it is desirable to apply high heat shrinkable elastic yarn, which is more shrinkable than the main inserted yarn, to the main elastic yarn and to heat shrink the main elastic yarn at the time finish treatment of the process or dyeing process for the warp knitted elastic fabric.

As a result, the inelastic main inserted yarn becomes loosened on the order of the shrinking amount of the main elastic yarn, and the inelastic main inserted yarn is able to follow the stretching of the main elastic yarn. In other words, stretching elasticity of the main elastic yarn is not restrained or limited by the inelastic main inserted yarn within the scope of shrinking amount of the main elastic yarn. Then, the warp knitted elastic fabric which is useful for the cushioning surface (24) of a car-seat and the like can be obtained.

Heat shrinking rate of the main elastic yarn may be 10~50%.

It is desirable to apply elastic yarn, which has elasticity approximately equal to the main elastic yarn, or polytrimethyleneterephthalate multifilament yarn, which has a high stretching property, to the axis yarn of the chenille yarn so that the main inserted yarn (chenille yarn) is able to follow the stretching of the main elastic yarn.

It is desirable to set up the gauge of the raschel warp knitting machine, in connection with total fineness of the main stitch yarn, the main elastic yarn and the main inserted yarn, 5.5 gauge/cm (14 gauge/inch) or 9.5 gauge/cm (24 gauge/inch).

In this case, wale density of the warp knitted elastic fabric may be set up 20~40 (wale/25.4 cm), and course density of the warp knitted elastic fabric may be set up 15~40 (course/25.4 cm).

FIG. 1 is a plan view of a warp knitted elastic fabric knitting process in accordance with the embodiment of the present invention.

Figure 4:
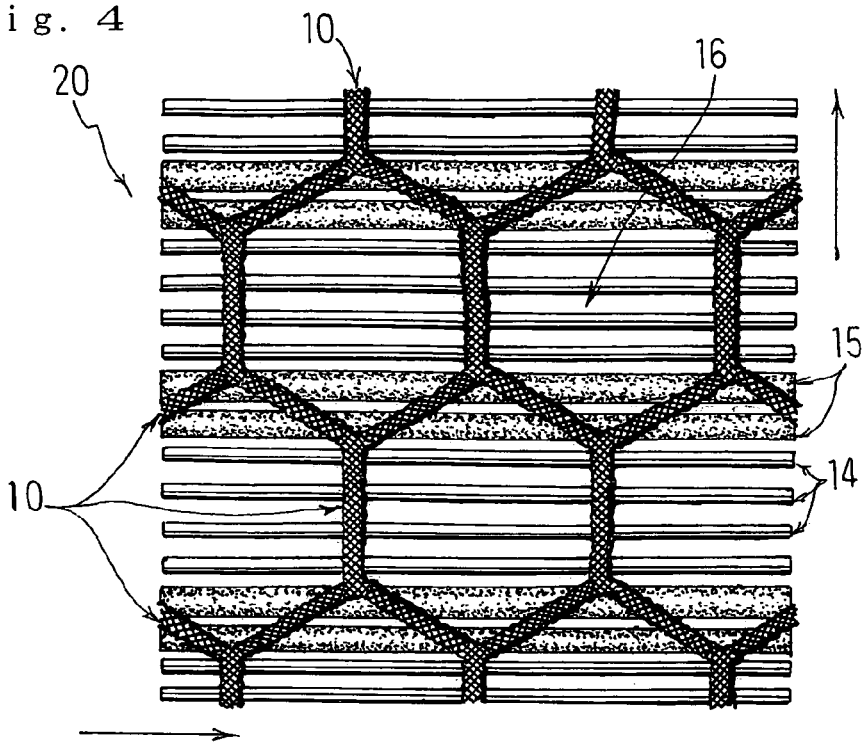
FIG. 4 is a plan view of a warp knitted elastic fabric made in accordance with the present invention.
Figure 5:
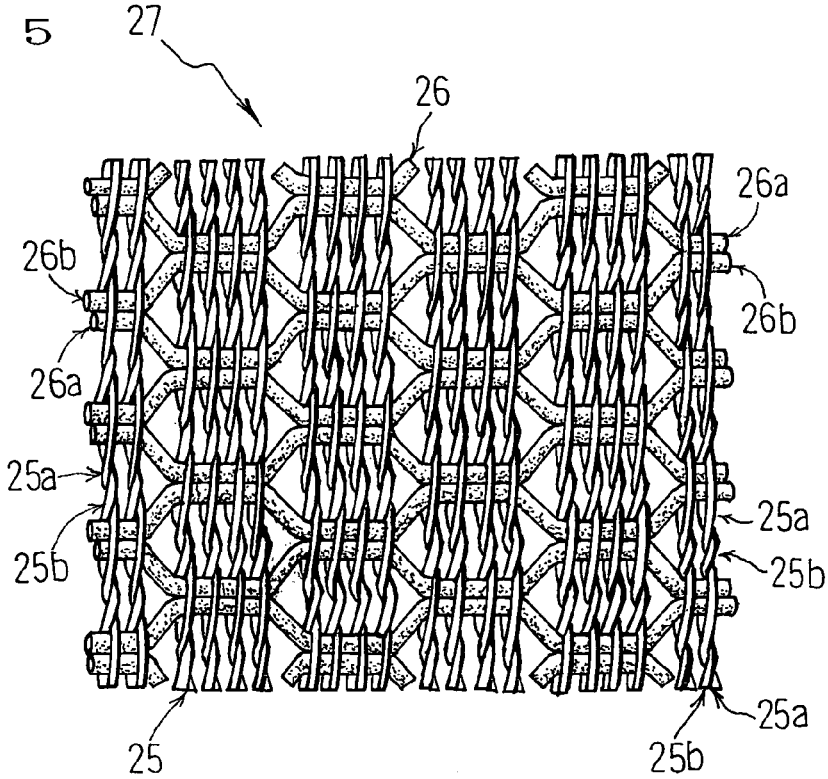
FIG. 5 is a plan view of a conventional woven elastic fabric.

FIG. 4 is a plan view of a warp knitted elastic fabric in accordance with the embodiment of the present invention.

Figure 3:
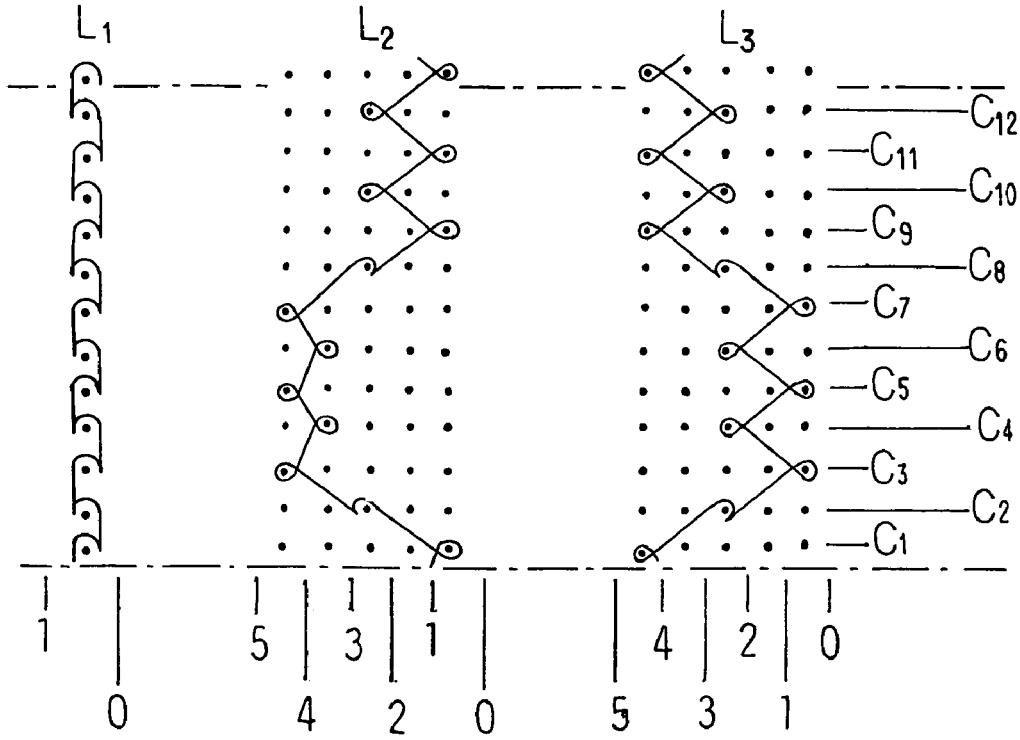
FIG. 3 is a schematic view of a knitting textile design of a warp knitted elastic fabric made in accordance with the present invention.

FIG. 3 is a schematic view of a knitting textile design of the warp knitted elastic fabrics of FIGS. 1 and 4, in accordance with the embodiment of the present invention.

The main stitch yarns are composed of the first main stitch yarns, the second main stitch yarns and the third main stitch yarns.

Polyether-ester monofilament elastic yarn (fineness: 300 dtex) is used for the first main stitch yarn (11).

Polyester multifilament yarn (total fineness: 500 dtex) is used for the second main stitch yarn (12) and the third main stitch yarn (13).

Polyether-ester monofilament elastic yarn (fineness: 2500 dtex) is used for the main elastic yarn (14).

Chenille yarn is used for the main inserted yarn (15).

This chenille yarn is formed by applying a polytrimethyleneterephthalate multifilament yarn (total fineness: 150 dtex) to a core-yarn, by twining polyester multifilament bulky texturized yarn (total fineness: 150 dtex) around the core-yarn with overfeeding rate of 200%, and by twining thermo-adhesive yarn (total fineness: 150 dtex, product name of Torey Co. Ltd. "Erder") to thermally adhere and fix the polyester multifilament bulky texturized yarn to the core-yarn.

A single raschel warp knitting machine, which has a weft yarn insert apparatus and three reeds ($L_1$), ($L_2$) and ($L_3$) (each 24 gauge/25.4 mm), is used to knit up a warp knitted elastic fabric (20).

The first main stitch yarns (11) are guided and knitted in by the first reed ($L_1$). The second main stitch yarns (12) are guided and knitted in by the second reed ($L_2$). The third main stitch yarns (13) are guided and knitted in by the third reed ($L_3$).

As shown in FIG. 3, the first reed ($L_1$) is knitted with a movement of 0-1/1-0/0-1/1-0/0-1/1-0/ for formation of one-in-one-out knitting textile design.

The second reed ($L_2$) is knitted with a movement of 1-0/2-3/4-5/3-2/4-5/3-2/4-5/3-2/1-0/2-3/1-0/ for formation of the knitting textile design.

The third reed ($L_3$) is knitted with a movement of 4-5/3-2/1-0/2-3/1-0/2-3/1-0/2-3/4-5/3-2/4-5/3-2/ for formation of the knitting textile design.

In this manner, the base knitted fabric (10) of 12 course/1 repeat is knitted up.

In this knitting process, the main inserted yarns (15) are inserted and knitted into the first course ($C_1$) and the second course ($C_2$) of the knitting textile design shown in FIG. 3.

After that, the main elastic yarns (14) are inserted and knitted into the third course ($C_3$), the fourth course ($C_4$), the fifth course ($C_5$) and the sixth course ($C_6$) of the knitting textile design.

After that, the main inserted yarns (15) are inserted and knitted again into the seventh course ($C_7$) and the eighth course ($C_8$) of the knitting textile design.

After that, the main elastic yarns (14) are inserted and knitted again into the ninth course ($C_9$), the tenth course ($C_{10}$), the eleventh course ($C_{11}$) and the twelfth course ($C_{12}$) of the knitting textile design.

In this manner, the main elastic yarns (14) and the main inserted yarns (15) are knitted in the base knitted fabrics (10).

As shown in FIG. 1, the sinker loops (18), which are formed from the main stitch yarn, are penetrated by the main elastic yarns (14) and the main inserted yarns (15) which are knitted in the base knitted fabric (10).

The loop-shaped needle loop (17) exists over one side of the main elastic yarns and the main inserted yarns, that is, the rear side of the drawing paper of FIG. 1.

On the other hand, over another side of the main elastic yarns and the main inserted yarns, that is, the surface side of the drawing paper of FIG. 1, a part of arch-shaped sinker loop (18) exists.

As a result, the main elastic yarns (14) and the main inserted yarns (15) are exposed (appear) over one side of the base knitted fabric (10), that is, the surface side of the drawing paper of FIG. 1, where parts of arch-shaped sinker loops (18) exist (appear), more than another side of the base knitted fabric (10), that is, the rear side of the drawing paper of FIG. 1, where the loop-shaped needle loop (17) exist (appear).

As mentioned above, the main inserted yarns (15) should be applied to restrain or avoid gloss and flatness which are caused (effected) from main elastic yarn (14) over the surface of the warp knitted elastic fabric (20).

So that, the warp knitted elastic fabric (20) is applied to the cushioning surface (24) of the car-seat or like article in a manner where the sinker loop surface side (18), that is, the surface side of the drawing paper of FIG. 1, where the main inserted yarns (15) are exposed more, is faced to the out side, that is, the out side of the article.

In accordance with the present invention, the warp knitted elastic fabric which is useful for the cushioning surface of a car-seat and like articles has the properties of resisting sagging and puckering resulting from load-hysteresis fatigue during use of the cushioning surface, has high dimensional stability and does not cause a distortion of stitch openings, is highly air-permeable, does not give a warm sticky feeling, is able to maintain limbs in comfortable posture without slippage when one sits on the cushioning surface, has soft touch feeling, is not glossy and has soft and quite natural fine appearance covered with fine fibers and is not similar to monotonous simple surface of the conventional plastic goods in appearance, and has a high market value.

The invention claimed is:

1. A warp knitted elastic fabric for a cushioning surface of a body support characterized by the following elements:

a base knitted fabric warp knitted from main stitch yarns;

main elastic yarns, of which single fiber fineness is 1000 to approximately 4000 dtex and of which stress at 10% elongation is more than 0.1 cN/dtex, knitted in the base knitted fabric in continuous line in a selected one of the knitting width direction and the knitting length direction;

main inserted yarns knitted in the base knitted fabric in continuous line in a selected one of the knitting width direction and the knitting length direction;

said main inserted yarns being more bulky than both said main elastic yarns and main stitch yarns, and said main inserted yarns being visually apparently thicker as an observed value of the thickness of the yarn than both said main elastic yarns and said main stitch yarns; and the surface of the main inserted yarns being composed of multiple fibers, the total fineness of the main stitch yarn being less than one half of the total fineness of the main elastic yarn.

2. A warp knitted elastic fabric for a cushioning surface of a body support as set forth in claim 1, wherein:

on the base knitted fabric, there are formed openings which are larger than the needle loop formed from main stitch yarn and which extend over plural knitting courses; and the base knitted fabric being formed with a mesh surface configuration.

3. A warp knitted elastic fabric for a cushioning surface of a body support as set forth in claim 1, wherein the main inserted yarn is chenille yarn which is formed with axis yarns and pile fibers for covering the axis yarns, and wherein said pile fibers project from the axis yarns.

4. A warp knitted elastic fabric for a cushioning surface of a body support as set forth in claim 1, wherein the main stitch yarn is comprised of a thermo-adhesive sheath core combination of polyether-ester yarn which is comprised of polyether-ester polymer applied to said core component polymer and thermo-adhesive polymer applied to said sheath component polymer which has a melting point being lower than the core component polymer.

5. A warp knitted elastic fabric for a cushioning surface of a body support as set forth in claim 1, said main elastic yarn is comprised of thermo-adhesive sheath core combination of polyether-ester elastic yarn which is comprised of polyether-ester elastic polymer applied to the core component polymer and thermo-adhesive polymer applied to said sheath component polymer which has a melting point lower than the core component polymer.

6. A warp knitted elastic fabric for a cushioning surface of a body support as set forth in claim 1, wherein the fineness of plurality of the main elastic yarns which is included within a unit distance in the knitting length direction or in the knitting width direction is more than 7000 dtex/cm.

7. A warp knitted elastic fabric for a cushioning surface of a body support as set forth in claim 1, wherein the main elastic yarn and the main inserted yarn are knitted in courses different from the courses of the based knitted fabric, the base knitted fabric being knitted with plural courses per one repeat in the knitting length direction of the base knitted fabric.

* * * * *